US006325143B1

(12) United States Patent
Scarsdale

(10) Patent No.: US 6,325,143 B1
(45) **Date of Patent: *Dec. 4, 2001**

(54) DUAL ELECTRIC SUBMERGIBLE PUMPING SYSTEM INSTALLATION TO SIMULTANEOUSLY MOVE FLUID WITH RESPECT TO TWO OR MORE SUBTERRANEAN ZONES

(75) Inventor: Kevin T. Scarsdale, Bartlesville, OK (US)

(73) Assignee: Camco International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/338,199

(22) Filed: Jun. 22, 1999

Related U.S. Application Data

(63) Continuation-in-part of application No. 09/225,045, filed on Jan. 4, 1999.

(51) Int. Cl.[7] ..... E21B 43/40
(52) U.S. Cl. ..... 166/54.1; 166/106
(58) Field of Search ..... 166/106, 105, 166/313, 369, 66.4, 54.1

(56) References Cited

U.S. PATENT DOCUMENTS

| | | | | |
|---|---|---|---|---|
| 1,861,332 | | 5/1932 | Waitz . | |
| 1,956,694 | | 5/1934 | Parrish | 166/10 |
| 2,910,002 | * | 10/1959 | Morgan | 166/54.1 |
| 2,982,357 | | 5/1961 | Kenneday | 166/115 |
| 2,991,833 | | 7/1961 | Brown et al. | 166/46 |
| 3,064,580 | * | 11/1962 | Calvert et al. | 166/54.1 |
| 3,170,520 | | 2/1965 | Arutunoff | 166/65 |
| 3,326,292 | * | 6/1967 | Young et al. | 166/106 |
| 3,765,483 | * | 10/1973 | Vencil | 166/54.1 |
| 4,399,865 | | 8/1983 | Anderson et al. | 166/191 |
| 4,595,057 | | 6/1986 | Deming et al. | 166/269 |
| 4,794,989 | | 1/1989 | Mills | 166/387 |
| 4,815,791 | | 3/1989 | Schmidt et al. | 299/4 |
| 5,271,462 | | 12/1993 | Berzin | 166/191 |
| 5,404,943 | * | 4/1995 | Strawn | 166/54.1 |
| 5,535,825 | | 7/1996 | Hickerson | 166/302 |
| 5,775,420 | | 7/1998 | Mitchell et al. | 166/85.4 |
| 5,832,520 | * | 12/1998 | Bolin | 166/106 X |
| 5,881,814 | * | 3/1999 | Mills | 166/313 |
| 6,033,567 | * | 3/2000 | Lee et al. | 210/512.2 |
| 6,092,599 | * | 7/2000 | Berry et al. | 166/54.1 X |
| 6,092,600 | * | 7/2000 | Mckinzie et al. | 166/106 X |

FOREIGN PATENT DOCUMENTS

| | | | | |
|---|---|---|---|---|
| 1454699 | * | 3/1976 | (GB) | 166/54.1 |

* cited by examiner

*Primary Examiner*—William Neuder
(74) *Attorney, Agent, or Firm*—Fletcher, Yoder & Van Someren

(57) ABSTRACT

A dual submergible pumping system permits the production and/or injection of fluids from or into separate zones within a narrowly confined wellbore without commingling of fluids. The system includes at least first and second electric submergible pumping systems. Typically, the design allows the electric submergible pumping systems to be arranged generally axially within a wellbore. Each system, however, is able to produce or inject fluids along a fluid flow path that is isolated from the fluid flow path of the other electric submergible pumping system.

24 Claims, 5 Drawing Sheets

DUAL ELECTRIC SUBMERGIBLE PUMPING SYSTEM INSTALLATION TO SIMULTANEOUSLY MOVE FLUID WITH RESPECT TO TWO OR MORE SUBTERRANEAN ZONES

RELATED APPLICATIONS

This document is a continuation-in-part of patent application Ser. No. 09/225,045, filed Jan. 4, 1999 and entitled Dual Electric Submergible Pumping Systems For Producing Fluids From Separate Reservoirs.

FIELD OF THE INVENTION

The present invention relates generally to systems for raising fluids from wells, and particularly to a dual electric submergible pumping system for use in a narrowly confined wellbore to produce or move fluids with respect to at least two zones and without commingling of the fluids.

BACKGROUND OF THE INVENTION

In producing petroleum and other useful fluids from production wells, it is generally known to provide a submergible pumping system for raising the fluids collected in a well. Production fluids enter a wellbore via perforations formed in a well casing adjacent a production formation. Fluids contained in the formation collect in the wellbore and may be raised by the submergible pumping system to another zone or to a collection point above the surface of the earth. Submergible pumping systems also are used to inject fluids into the formation to contain or move a reservoir of production fluid so that it may be produced more readily from a given location.

In an exemplary electric submergible pumping system, the system includes several components, such as a submergible pump, a submergible electric motor and motor protector. The submergible electric motor typically supplies power to the submergible pump by a drive shaft, and the motor protector serves to isolate the internal motor oil from the well fluids. A deployment system, such as deployment tubing in the form of coiled tubing or production tubing, is used to deploy the submergible pumping system within a wellbore. Generally, power is supplied to the submergible electric motor or motors by one or more power cables supported along the deployment system.

Some wells have the capability of producing from two or more zones or reservoirs. However, because of constraints, such as incompatibility of fluids, differential pressures in the reservoirs, and other constraints, it sometimes is undesirable to commingle the fluids produced from separate production zones.

Production from the separate zones or reservoirs can be accomplished by running separate electric submergible pumping systems along side of one another and deployed on separate tubing strings. In some applications, however, this may be problematic due to space constraints. In other words, the wellbore must be of substantial diameter to accommodate two separate systems that are deployed along side of one another. These problems are equally applicable if one of the systems is used for injection of fluids, while the other is used for production of fluids.

It would be advantageous to have a dual electric submergible pumping system that could be deployed either on a single tubing deployment system within a narrowly confined wellbore, or on a pair of tubing deployment systems with the two or more electric submergible pumping systems arranged generally axially. Additionally, it would be advantageous to utilize separate fluid flow paths to prevent commingling of fluids pumped from or injected into separate zones.

SUMMARY OF THE INVENTION

The present invention features a system for producing fluids from two different zones within a wellbore. The system includes a first electric submergible pumping system coupled to a first intake that is disposed in a first zone. A second electric submergible pumping system is coupled to a second intake that is disposed in a second zone. A packer separates the first electric submergible pumping system from the second electric submergible pumping system. This packer is disposed within the wellbore between a first zone fluid and a second zone fluid.

According to another aspect of the invention, a system is provided for producing fluids from two different zones within a wellbore. The system includes a first electric submergible pumping system coupled to a first intake that is disposed in a first zone. The system also includes a second electric submergible pumping system coupled to a second intake disposed in a second zone. A lower packer is disposed to separate the first zone from the second zone and is disposed beneath the first and the second electric submergible pumping systems. Additionally, an upper packer is disposed between the first and the second submergible pumping systems.

According to another aspect of the present invention, a system is provided for producing fluid from two different zones within a wellbore. A first electric submergible pumping system is coupled to a first intake that is disposed in a first zone. A second electric submergible pumping system is coupled to a second intake that is disposed in a second zone. The second electric submergible pumping system is suspended from the first electric submergible pumping system. Additionally, a first packer is disposed between the first electric submergible pumping system and the second electric submergible pumping system. A second packer also is disposed between the first electric submergible pumping system and the second electric submergible pumping system to create a zone therebetween in which the first intake is deployed.

According to another aspect of the invention, a system is provided for use in a downhole, wellbore environment to manage fluid flow with respect to a plurality of zones. The system includes a first electric submergible pumping system coupled to a first intake that is disposed in a first zone. The system also includes a second electric submergible pumping system coupled to a second intake that is disposed in a second zone. A first packer is disposed between the first electric submergible pumping system and the second electric submergible pumping system. Also, a second packer is disposed to separate the second zone from a third zone. The arrangement allows the first electric submergible pumping system to produce a first zone fluid from the first zone, while the second electric submergible pumping system moves a second zone fluid from the second zone to the third zone.

According to another aspect of the present invention, a system is provided for use in a downhole, wellbore environment to simultaneously inject one fluid and to produce another fluid. The system includes first and second electric submergible pumping systems. The first electric submergible pumping system is coupled to a first intake disposed in a production zone. The second electric submergible pumping system is coupled to a second intake that may be supplied with an injection fluid. The first electric submergible pumping system is suspended from the second electric submergible pumping system. Further, a deployment tubing is coupled to the second electric submergible pumping system, and a bypass is connected between the first electric submergible pumping system and the deployment tubing. When a production fluid is produced from the production zone, the first electric submergible pumping system moves the production fluid through the bypass and up through the deployment tubing.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
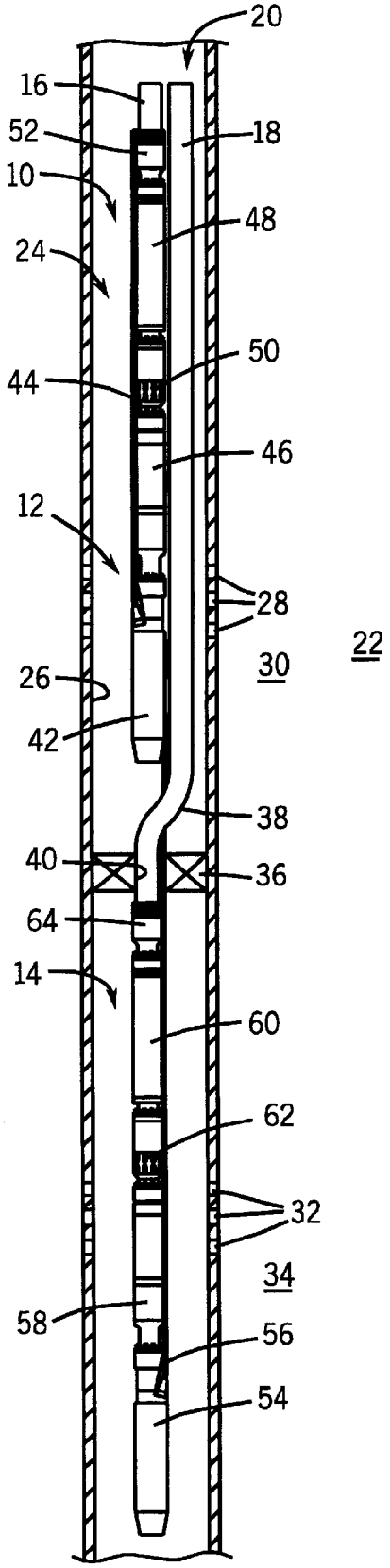
FIG. 1 is a front elevational view of a dual electric submergible pumping system positioned in a wellbore, according to a preferred embodiment of the present invention.

Referring generally to FIG. 1, a dual electric submergible pumping system 10 is illustrated according to a preferred embodiment of the present invention. System 10 may comprise a variety of components depending on the particular application or environment in which it is used. However, system 10 typically includes a first electric submergible pumping (ESP) system 12 and a second electric submergible pumping (ESP) system 14. First ESP system 12 and second ESP system 14 are deployed by a first deployment tubing 16 and second deployment tubing 18, respectively. First deployment tubing 16 and second deployment tubing 18 may be, for example, conventional production tubing for conducting a fluid therethrough.

System 10 is designed for deployment in a well 20 within a geological formation 22 containing desirable production fluid, such as petroleum. Typically, a wellbore 24 is drilled into geological formation 22 and lined with a wellbore casing 26. Wellbore casing 26 may include a plurality of perforations for permitting the flow of fluid from formation 22 into wellbore 24 for transfer by system 10. For example, a first set of perforations 28 may be disposed in a first zone 30 to permit a first zone fluid to flow into wellbore 24 via perforations 28. A second set of perforations 32 may be disposed at a second zone 34 to permit the flow of a second zone fluid into wellbore 24 via perforations 32. In this exemplary embodiment, first zone 30 is vertically above second zone 34 along wellbore 24.

First zone 30 and the first zone fluid is separated from second zone 34 and the second zone fluid, at least within wellbore 24, by a packer 36 disposed between first ESP system 12 and second ESP system 14. Thus, fluid from first zone 30 is produced by first ESP system 12 through first deployment tubing 16. Similarly, the fluid from zone 34 is produced by second ESP system 14 through second deployment tubing 18. Second deployment tubing 18 includes a bend 38 that permits second ESP system 14 to be disposed beneath first ESP system 12, and most preferably in general axial alignment with first ESP system 12. The second deployment tubing 18 extends upwardly from bend 38 along the side of first ESP system 12. This arrangement permits the deployment of dual ESP system 10 in smaller diameter wellbores or when subjected to greater space constraints. Typically, packer 36 is disposed between bend 38 and second ESP system 14. Packer 36 includes a central opening or aperture 40 for receiving the second deployment tubing 18 therethrough.

By way of example, first ESP system 12 includes a submergible electric motor 42 that receives power via a power cable 44. Motor 42 is coupled to a motor protector 46. First ESP system 12 also includes a submergible pump 48 coupled to a fluid intake 50 that may be coupled, for example, to motor protector 46 and pump 48, as illustrated. At the upper end of pump 48 a connector 52 connects pump 48 with first deployment tubing 16.

Similarly, second ESP system 14 includes a submergible motor 54 powered via a power cable 56. A motor protector 58 is coupled to motor 54. System 14 further includes a submergible pump 60 coupled to a fluid intake 62. Intake 62 is connected between pump 60 and motor protector 58. Additionally, a connector 64 is coupled between pump 60 and second deployment tubing 18, as illustrated. It should be noted that the components and arrangement of components in each electric submergible pumping system 12, 14 can be changed or adjusted according to the specific application or environment in which dual system 10 is utilized.

To operate dual electric submergible pumping system 10, second ESP system 14 and packer 36 are initially deployed within wellbore 24. Subsequently, first ESP system 12 is deployed above second ESP system 14. As a first zone fluid flows through perforations 28 into wellbore 24, the fluid is drawn into intake 50 and pumped upwardly through first deployment tubing 16. Simultaneously, a second zone fluid flows through perforations 32 into wellbore 24 and is drawn into intake 62 and pumped upwardly through second deployment tubing 18. Packer 36 separates first zone 30 and the first zone fluid from second zone 34 and the second zone fluid within wellbore 24 to prevent commingling of fluids.

Figure 2:
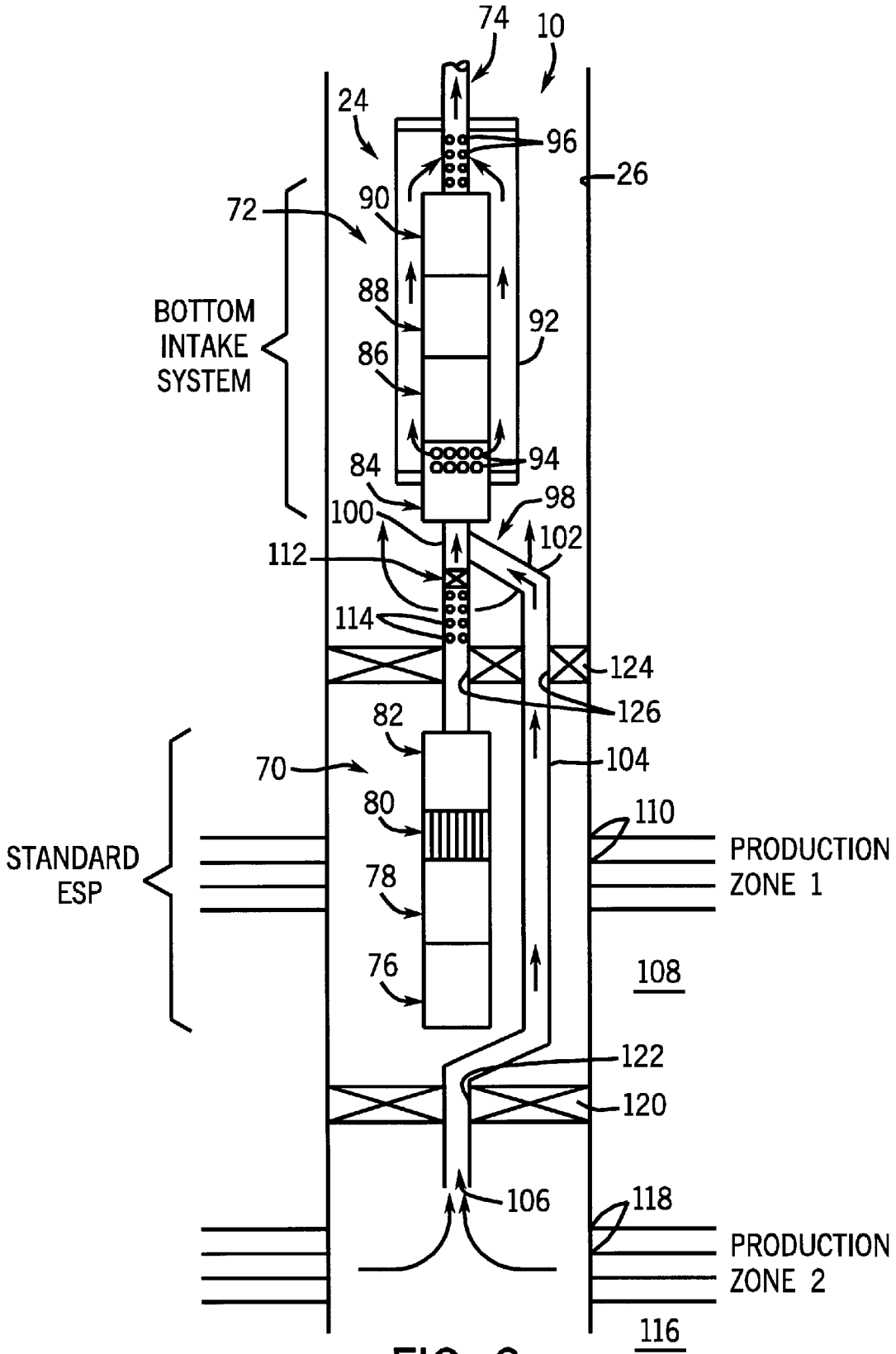
FIG. 2 is a front elevational view of an alternate embodiment of the system illustrated in FIG. 1.

Referring generally to FIG. 2, an alternate embodiment of the present invention is illustrated. In this embodiment, the dual system 10 includes a first ESP system 70 and a second ESP system 72. Both first and second ESP systems 70, 72 are deployed on a single deployment system 74, e.g. production tubing.

First ESP system 70 may include a variety of components. For example, a submergible motor 76, a motor protector 78, a fluid intake 80 and a submergible pump 82, as illustrated. A connector and power cable, as described above, also are typically used but have not been shown in this embodiment or the subsequent embodiments for clarity of illustration.

Second ESP system 72, on the other hand, preferably is a bottom intake style system having a lower submergible pump 84. In the illustrated exemplary embodiment, a motor protector 86 is coupled to pump 84 and disposed above pump 84. A submergible motor 88 is coupled to motor protector 86, and an expansion chamber 90 is disposed above motor 88. Fluid is drawn into pump 84 and discharged into a shroud 92 through discharge openings 94. The discharged fluid travels upwardly along the outside of motor protector 84, motor 88 and expansion chamber 90, within shroud 92, until it is forced into deployment tubing 74 through deployment tubing inlet 96.

Preferably, first ESP system 70 is suspended from second ESP system 72 by a Y-tool 98. Specifically, Y-tool 98 includes a primary branch 100 that extends to first ESP system 70. Additionally, Y-tool 98 has a secondary branch 102 coupled to downwardly extending tubing 104 which extends to an intake 106 for second ESP system 72. In operation, a first zone fluid from a first zone 108 enters wellbore 24 via appropriate perforations 110 formed through wellbore casing 26. This first zone fluid is drawn into intake 80 of first ESP system 70 and pumped upwardly through the interior of primary branch 100 of Y-tool 98. A plug 112 prevents the first zone fluid from reaching second ESP system 72. Rather, the first zone fluid is dispelled through an outlet 114 formed through the wall of primary branch 100 beneath plug 112. This fluid is moved upwardly through wellbore 24 along the annulus formed within wellbore casing 26 and around second ESP system 72 and deployment system 74.

Simultaneously, a second zone fluid flows from a second zone 116 into wellbore 24 through appropriate perforations 118 formed in wellbore casing 26. This second zone fluid is drawn into intake 106 by second ESP system pump 84 via tubing 104 and secondary branch 102 of Y-tool 98. This second zone fluid is routed along second ESP system 72 and forced upwardly through the interior of deployment tubing 74.

First zone 108 and the first zone fluid are separated from second zone 116 and the second zone fluid, within wellbore 24, by a lower packer 120. Preferably, lower packer 120 is disposed beneath both first and second ESP systems 70, 72 and includes an opening or aperture 122 through which tubing 104 extends. Thus, intake 106 is positioned within the second zone 116 to draw second zone fluids.

Additionally, an upper packer 124 preferably is disposed between first ESP system 70 and second ESP system 72 to separate first zone 108 from the annulus through which first zone fluid is produced. Preferably, upper packer 124 includes a pair of openings 126 through which both primary branch 100 and tubing 104 extend, as illustrated. In this arrangement, dual system 10 may be deployed within wellbore 24 in a single operation, because first ESP system 70 and second ESP system 72 are integrally connected.

Figure 3:
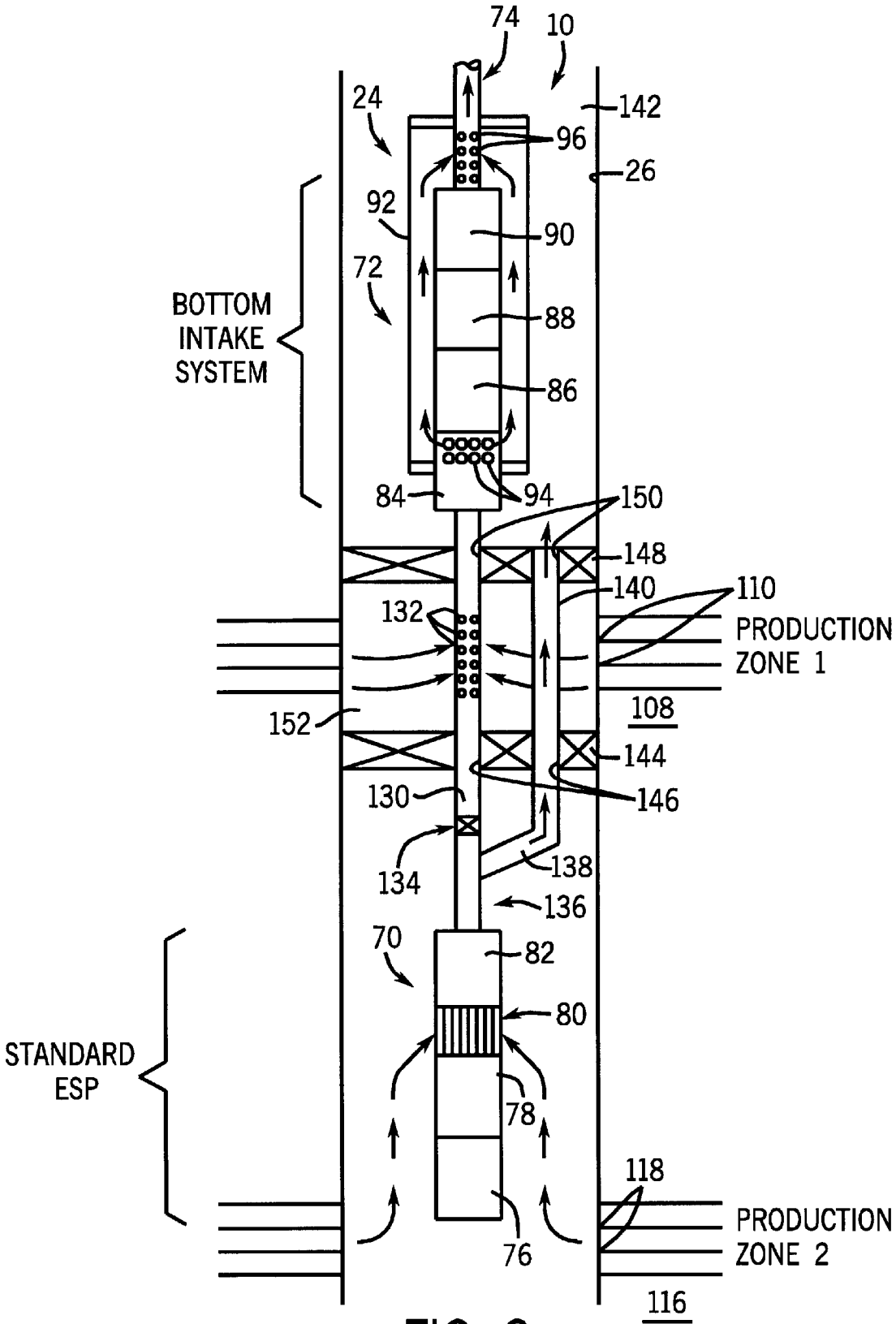
FIG. 3 is a front elevational view of another alternate embodiment of the system illustrated in FIG. 1.

Referring generally to FIG. 3, another alternate embodiment of system 10 is illustrated. In this exemplary embodiment, many of the components referenced are the same as the components referenced in FIG. 2 and are provided with the same reference numerals. In this latter embodiment, however, upper ESP system 72 draws first zone fluid from first zone 108. Lower ESP system 70, on the other hand, draws second zone fluid from second zone 116.

Lower ESP system 70 is suspended from upper ESP system 72 by a tubing 130. Tubing 130 preferably is a generally straight tube that holds lower ESP system 70 in general axial alignment with upper ESP system 72. Additionally, tubing 130 includes one or more perforations 132 disposed to draw first zone fluids into pump 84 of the bottom intake style upper ESP system 72. Additionally, a plug 134 is disposed in tubing 130 beneath the one or more perforations 132. In an exemplary embodiment, tubing 130 is the primary branch of a Y-tool 136 connected to lower ESP system 70. A secondary branch 138 of Y-tool 136 is coupled to a section of tubing 140 that extends upwardly towards an annulus 142 formed between wellbore casing 26 and deployment system 74. Lower ESP system 70 draws second zone fluid from second zone 116 into intake 80 and pumps the fluid upwardly through secondary branch 138 of Y-tool 136 and on through tubing section 140 to annulus 142.

First zone 108 and the first zone fluid are separated from second zone 116 and the second zone fluid by a lower packer 144. Lower packer 144 preferably includes a pair of openings 146 through which tubing sections 130 and 140 extend. Lower packer 144 is disposed beneath the one or more perforations 132. Additionally, an upper packer 148 is disposed in wellbore 24 above one or more perforations 132. Packer 148 separates first zone 108 and first zone fluid from the second zone fluid pumped into annulus 142. Upper packer 148 also includes a pair of openings 150 through which tubing sections 130 and 140 extend, as illustrated.

Upper packer 148 is disposed above the one or more perforations 132 to create a contained area 152 at which first zone fluids are drawn into the one or more perforations 132. As illustrated, lower packer 144 and upper packer 148 preferably are disposed between lower ESP system 70 and upper ESP system 72.

Figure 4:
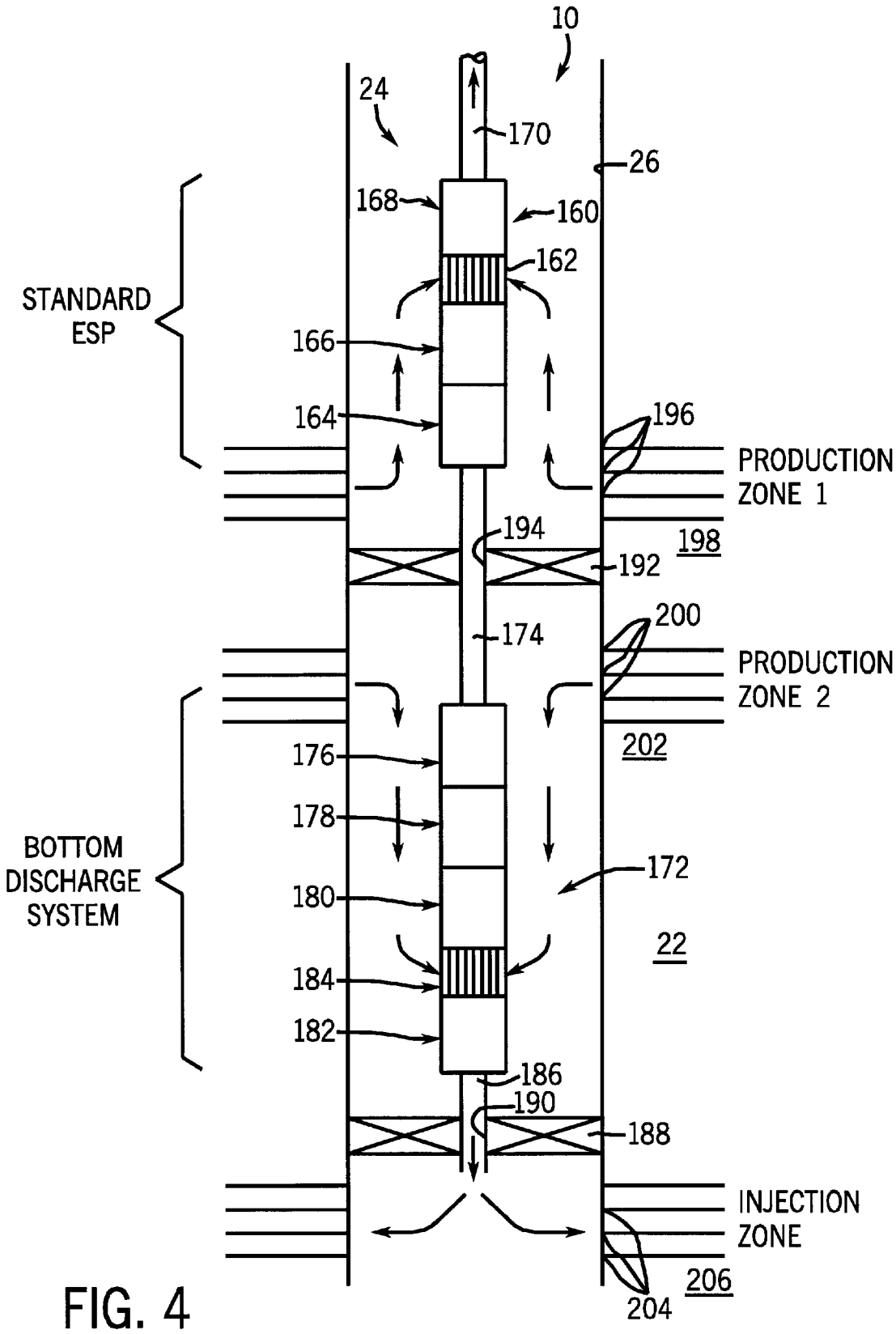
FIG. 4 is a front elevational view of another alternate embodiment of the system illustrated in FIG. 1.

Referring generally to FIG. 4, another alternate embodiment of dual system 10 is illustrated. The exemplary system is utilized in a downhole, wellbore environment for the management of fluid flow from or to a plurality of zones. In the embodiment illustrated, an upper ESP system 160 is coupled to a fluid intake 162. Upper ESP system 160 preferably is a standard ESP including a lower, submergible motor 164, a motor protector 166, pump intake 162 and a submergible pump 168. The upper ESP system 160 is deployed on an appropriate deployment tubing 170, such as production tubing.

Dual system 10 also includes a lower ESP system 172. Lower ESP system 172 preferably is suspended from upper ESP system 160 by, for instance, a section of tubing 174, such that lower ESP system 172 is generally axially aligned with upper ESP system 160.

In the illustrated embodiment, lower ESP system 172 is a bottom discharge system including an upper expansion chamber 176, a motor 178, a motor protector 180 and a pump 182. Lower ESP 172 is coupled with a liquid intake 184 which, in the illustrated embodiment, is coupled between motor protector 180 and pump 182.

A discharge tube 186 is coupled to pump 182 and extends downwardly therefrom. A lower packer 188 is disposed beneath lower ESP system 172 and includes an opening 190 for receiving discharge tube 186. An upper packer 192 is disposed between upper ESP system 160 and lower ESP system 172. Upper packer 192 includes an opening 194 through which tubing section 174 extends. Thus, lower packer 188 and upper packer 192 create three separate zones, at least within wellbore 24. Wellbore casing 26 includes an upper area of perforations 196 disposed proximate a first zone 198 to permit first zone fluids to flow into wellbore 24 above upper packer 192. Additionally, a second set of perforations 200 are disposed through wellbore casing 26 intermediate upper packer 192 and lower packer 188. This permits the flow of second zone fluid from a second zone 202 into wellbore 24 intermediate upper packer 192 and lower packer 188. Additionally, wellbore casing 126 includes a third set of perforations 204 formed beneath lower packer 188. Perforations 204 permit the injection of fluids into a third zone 206, commonly referred to as an injection zone.

In operation, first zone fluid is drawn through perforations 196 at first zone 198 and into intake 162. This production fluid is pumped upwardly through deployment tubing 170 to an appropriate collection site. Simultaneously, a second zone fluid is drawn through perforations 202 and into intake 184 of lower ESP system 172. This second zone fluid is discharged through discharge tube 186 into wellbore 24 beneath lower packer 188. As this second zone fluid is continually discharged, it is forced through perforations 204 at injection zone 206. Thus, the two ESP systems can simultaneously produce and inject appropriate fluids.

Figure 5:
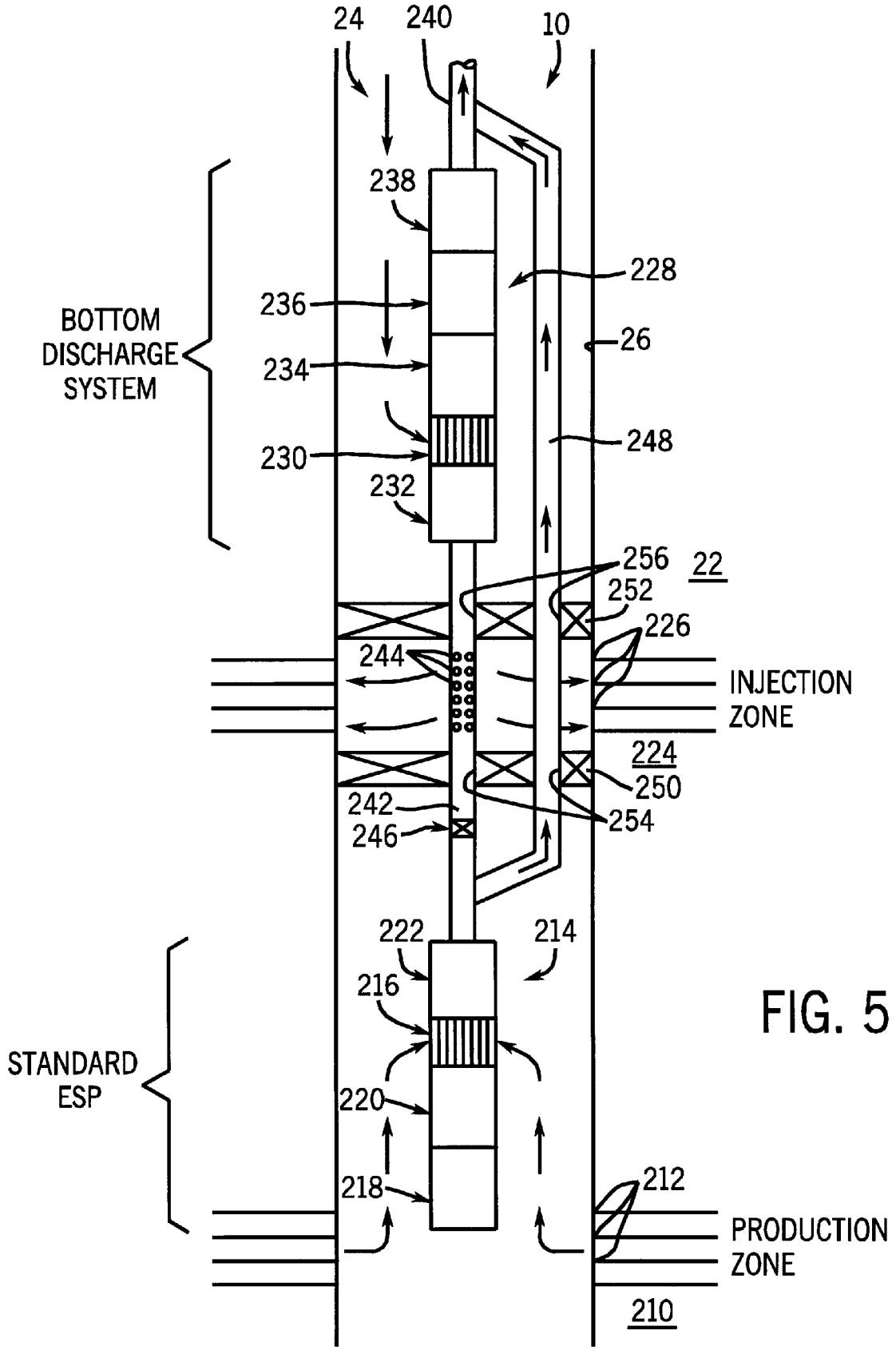
FIG. 5 is a front elevational view of another alternate embodiment of the system illustrated in FIG. 1.

Another embodiment of a system 10 able to produce fluid and inject fluid simultaneously is illustrated in FIG. 5. In this embodiment, a fluid is produced from a lower zone 210, referred to as a production zone. At zone 210, a production fluid flows through a set of perforations 212 formed through wellbore casing 26. The fluid flows into wellbore 24 and is produced upwardly by a lower ESP system 214. Lower ESP system 214 is coupled to a fluid intake 216 which draws in the production fluid at lower zone 210.

Preferably, lower ESP system 214 is a standard ESP system including, for instance, a lower motor 218, a motor protector 220 and a submergible pump 222. Potentially, a wide range of additional or other components can be utilized in lower ESP system 214. Preferably, intake 216 is coupled between motor protector 220 and submergible pump 222 in the exemplary embodiment.

In the embodiment illustrated, another zone 224, such as an injection zone, is disposed above lower zone 210. At zone 224, a set of perforations 226 are formed through wellbore casing 26. Perforations 226 permit an upper ESP system 228 to pump fluid from another zone or area and inject that fluid outwardly through perforations 226 into formation 22 at zone 224. Upper ESP system 228 preferably is a bottom discharge type system coupled to a fluid intake 230.

As described above with reference to FIG. 4, an exemplary bottom discharge system may include a submergible pump 232, a motor protector 234, a submergible motor 236 and an expansion chamber 238. In this embodiment, intake 230 preferably is coupled between the lower pump 232 and motor protector 234. As with each of the embodiments described above, a variety of additional or other components may also be utilized in the ESP system, e.g. upper ESP system 228, depending on the specific application and/or environment.

Upper ESP system 228 is suspended by a deployment system 240, such as deployment tubing. Lower ESP system 214 is suspended from upper ESP system 228 by, for instance, a section of tubing 242 that suspends lower ESP system 214 in general axial alignment with upper ESP system 228.

Section of tubing 242 includes an outlet 244 that permits the outflow of fluid pumped downwardly from upper ESP system 228. Additionally, a plug 246 is disposed in section of tubing 242 beneath outlet 244. Thus, as upper ESP system 228 pumps fluid downwardly through tubing 242, plug 246 forces the fluid to exit into wellbore 24 through outlet 244. This fluid is ultimately forced out of wellbore 24 through perforations 226 at injection zone 224.

A bypass 248 is coupled between lower ESP system 214 and, preferably, deployment system 240. As illustrated, bypass 248 may comprise a tube coupled with section of tubing 242 beneath plug 246. Thus, fluid pumped by lower ESP system 214 is forced into section of tubing 242 and blocked from further upward movement by plug 246. The fluid is then forced through bypass 248 and moves upwardly past upper ESP system 228 until it moves into deployment tubing 240. As with any of the systems described herein, deployment tubing 240 directs the produced fluid to another location, such as a collection point at the surface of the earth.

A lower packer 250 and an upper packer 252 are disposed between lower ESP system 214 and upper ESP system 228. Preferably, lower packer 250 is disposed beneath perforations 226 and upper packer is disposed above perforations 226. Thus, as fluid is pumped outwardly through outlet 244, lower packer 250 and upper packer 252 define a constrained region within wellbore 24. This region ensures that the fluid moves out through perforations 226 at injection zone 224 without commingling with the fluid produced from lower zone 210.

It should be noted that lower packer 250 preferably has a pair of openings 254 through which section of tubing 242 and bypass 248 extend. Similarly, upper packer 252 includes a pair of openings 256 through which section of tubing 242 and bypass 248 extend.

In operation, lower ESP system 214 draws a fluid from zone 210 into intake 216. This fluid is pumped upwardly into the lower of portion of tubing 242 and around upper ESP system 228 via bypass 248. The produced fluid is then directed into deployment tubing 240 which routes the fluid to a desired location, such as a collection point at the surface of the earth. Simultaneously, upper ESP system 228 draws fluid from a location in wellbore 24 above upper packer 252. This fluid is drawn through intake 230 and directed downwardly through section of tubing 242. Plug 246 ensures that the fluid is forced outwardly through outlet 244 between lower packer 250 and upper packer 252. This fluid is further forced through perforations 226 at zone 224 as it is injected into formation 22. Thus, the dual system 10 can simultaneously produce fluid from one zone while injecting fluid into another zone, such as injection zone 224 disposed above the lower production zone 210.

The fluid for injection is supplied from another zone or area. For example, depending on formation 22, the fluid could be supplied from an upper zone in formation 22. Preferably, however, the fluid is supplied from the surface of the earth and directed downwardly through wellbore 24 in the annulus formed around deployment tubing/system 240.

It will be understood, however, that the foregoing description is of preferred embodiments of this invention, and that the invention is not limited to the specific forms shown. For example, a variety of additional submergible pumping system components can be incorporated into the designs; a variety of different packers may be utilized; various control lines may be directed to the electric submergible pumping systems, such as fluid control lines, optical fibers and conductive control lines; different diameters and sizes of the tubing and other components can be selected as required or desired for a specific application; and preferably the dual ESP systems are axially aligned above one another, but this can vary somewhat depending on wellbore size, component diameters, or application. Additionally, the terms "first" and "second" as well as "upper" and "lower" are designed for aiding in the description of the overall system, and should not be construed as requiring a specific orientation or arrangement of components. These and other modifications may be made in the design and arrangement of the elements without departing from the scope of the invention as expressed in the appended claims.

What is claimed is:

1. A system for producing fluids from different zones within a wellbore, comprising:

a first electric submergible pumping system coupled to a first intake that is disposed in a first zone for receiving a first zone fluid;

a second electric submergible pumping system coupled to a second intake disposed in a second zone for receiving a second zone fluid;

a lower packer disposed to separate the first zone fluid from the second zone fluid, wherein the lower packer is disposed beneath the first and the second electric submergible pumping systems; and an upper packer disposed between the first and the second submergible pumping systems.

2. The system as recited in claim 1, wherein the first electric submergible pumping system is suspended from the second electric submergible pumping system by a Y-tool.

3. The system as recited in claim 2, wherein the second electric submergible pumping system is a bottom intake electric submergible pumping system.

4. The system as recited in claim 3, wherein the second intake is disposed beneath the lower packer.

5. The system as recited in claim 4, further comprising a deployment tubing through which a fluid is produced by the second electric submergible pumping system.

6. The system as recited in claims 5, wherein the first electric submergible pumping system is disposed to produce a production fluid through an annulus formed around the production tubing.

7. A system for producing fluids from different zones within a wellbore, comprising:

a first electric submergible pumping system coupled to a first intake that is disposed in a first zone;

a second electric submergible pumping system coupled to a second intake that is disposed in a second zone, the second electric submergible pumping system being suspended from the first electric submergible pumping system;

a first packer disposed between the first electric submergible pumping system and the second electric submergible pumping system; and a second packer disposed between the first electric submergible pumping system and the second electric submergible pumping system, wherein the first intake is disposed between the first packer and the second packer.

8. The system as recited in claim 7, wherein the first electric submergible pumping system is a bottom intake electric submergible pumping system.

9. The system as recited in claim 8, wherein the first electric submergible pumping system includes a shroud.

10. The system as recited in claim 8, further comprising a deployment tubing through which a first zone fluid is produced by the first electric submergible pumping system.

11. The system as recited in claim 7, wherein the second electric submergible pumping system is suspended by a Y-tool disposed beneath the first and second packers.

12. The system as recited in claim 11, wherein the Y-tool includes a primary branch and a secondary branch, the primary branch being plugged and the secondary branch being coupled to a conduit extending through the first and second packers.

13. The system as recited in claim 12, wherein a second zone fluid is produced by the second electric submergible pumping system through an annulus formed within the wellbore around the deployment tubing.

14. The system as recited in claim 7, wherein the first electric submergible pumping system and the second electric submergible pumping system are generally axially aligned.

15. A system for use in a downhole, wellbore environment to manage fluid with respect to a plurality of zones, comprising:

a first electric submergible pumping system coupled to a first intake that is disposed in a first zone for receiving a first zone fluid;

a second electric submergible pumping system coupled to a second intake that is disposed in a second zone for receiving a second zone fluid;

a first packer disposed between the first electric submergible pumping system and the second electric submergible pumping system to separate the first zone fluid from the second zone fluid; and a second packer disposed to separate the second zone from a third zone, wherein the first electric submergible pumping system produces the first zone fluid from the first zone and the second electric submergible pumping system moves the second zone fluid from the second zone to the third zone.

16. The system as recited in claim 15, wherein the first electric submergible pumping system is suspended from a deployment tubing through which the first zone fluid is produced.

17. The system as recited in claim 16, wherein the third zone is disposed beneath the second zone in a wellbore.

18. The system as recited in claim 17, wherein a fluid conduit extends from the second electric submergible pumping system through the second packer to conduct second zone fluid from the second zone to the third zone.

19. The system as recited in claim 18, wherein the first electric submergible pumping system is generally axially aligned with the second electric submergible pumping system.

20. A system for use in a downhole, wellbore environment to simultaneously inject one fluid and produce another fluid, comprising:

a first electric submergible pumping system coupled to a first intake disposed in a production zone;

a second electric submergible pumping system coupled to a second intake disposed to receive an injection fluid, the first electric submergible pumping system being suspended from the second electric submergible pumping system;

a deployment tubing coupled to the second electric submergible pumping system; and a bypass coupled between the first electric submergible pumping system and the deployment tubing, wherein a production fluid is produced through the bypass and the deployment tubing from the production zone.

21. The system as recited in claim 20, further comprising a first packer and a second packer disposed between the first electric submergible pumping system and the second submergible pumping system to create an injection zone therebetween.

22. The system as recited in claim 21, further comprising an outlet coupled to the second electric submergible pumping system and disposed in the injection zone.

23. The system as recited in claim 22, wherein the second intake is disposed to draw an injection fluid from an annulus formed in the wellbore around the second electric submergible pumping system.

24. The system as recited in claim 21, wherein the bypass extends through the first packer and the second packer.

* * * * *